US006014307A

United States Patent [19]

Crimmins

[11] Patent Number: 6,014,307

[45] Date of Patent: Jan. 11, 2000

[54] FIRE DOOR OPERATOR HAVING AN INTEGRATED ELECTRONICALLY CONTROLLED DESCENT DEVICE

[75] Inventor: Terence E. Crimmins, Northport, N.Y.

[73] Assignee: The Chamberlain Group, Inc., Elmhurst, Ill.

[21] Appl. No.: 09/046,998

[22] Filed: Mar. 24, 1998

[51] Int. Cl.[7] ..... H01H 47/00

[52] U.S. Cl. ..... 361/170; 361/51

[58] Field of Search ..... 361/170, 171, 361/172, 51; 388/809, 815, 828; 160/1, 7, 8, 188, 133, 310; 49/31, 139, 28; 307/64, 66; 318/266, 466, 467

[56] References Cited

U.S. PATENT DOCUMENTS

| | | | |
|---|---|---|---|
| 4,006,392 | 2/1977 | Catlett et al. | 318/266 |
| 4,147,197 | 4/1979 | Bailey et al. | 160/7 |
| 4,369,399 | 1/1983 | Lee et al. | 218/467 |
| 4,671,384 | 6/1987 | Sing | 182/231 |
| 4,698,622 | 10/1987 | Goto et al. | 340/648 |
| 4,776,433 | 10/1988 | Lagree et al. | 187/103 |
| 4,904,880 | 2/1990 | Yoshida | 307/66 |
| 5,203,392 | 4/1993 | Shea | 160/7 |
| 5,245,879 | 9/1993 | McKeon | 74/2 |
| 5,576,581 | 11/1996 | Iammuzzi et al. | 307/117 |
| 5,634,607 | 6/1997 | Kwoka | 160/310 |
| 5,642,767 | 7/1997 | Nair | 160/8 |
| 5,673,514 | 10/1997 | McKeon | 49/30 |

*Primary Examiner*—Jeffrey Gaffin
*Assistant Examiner*—Kim Huynh
*Attorney, Agent, or Firm*—Fitch, Even, Tabin & Flannery

[57] ABSTRACT

A fire door opener and method of electronically controlling the door descent speed is described. The operator includes a DC brake solenoid coupled to an AC motor drive system with an inline gear reducer and an electronically controlled descent device with battery backup power. If the brake is disengaged, the door will drop by overcoming the internal inertia and friction in the inline gear reducer. Speed of descent is controlled electronically by measuring the descent speed of the fire door at its limit shaft and electrically modulating the brake engagement using the DC solenoid.

13 Claims, 16 Drawing Sheets

Microfiche Appendix Included
(4 Microfiche, 41 Pages)

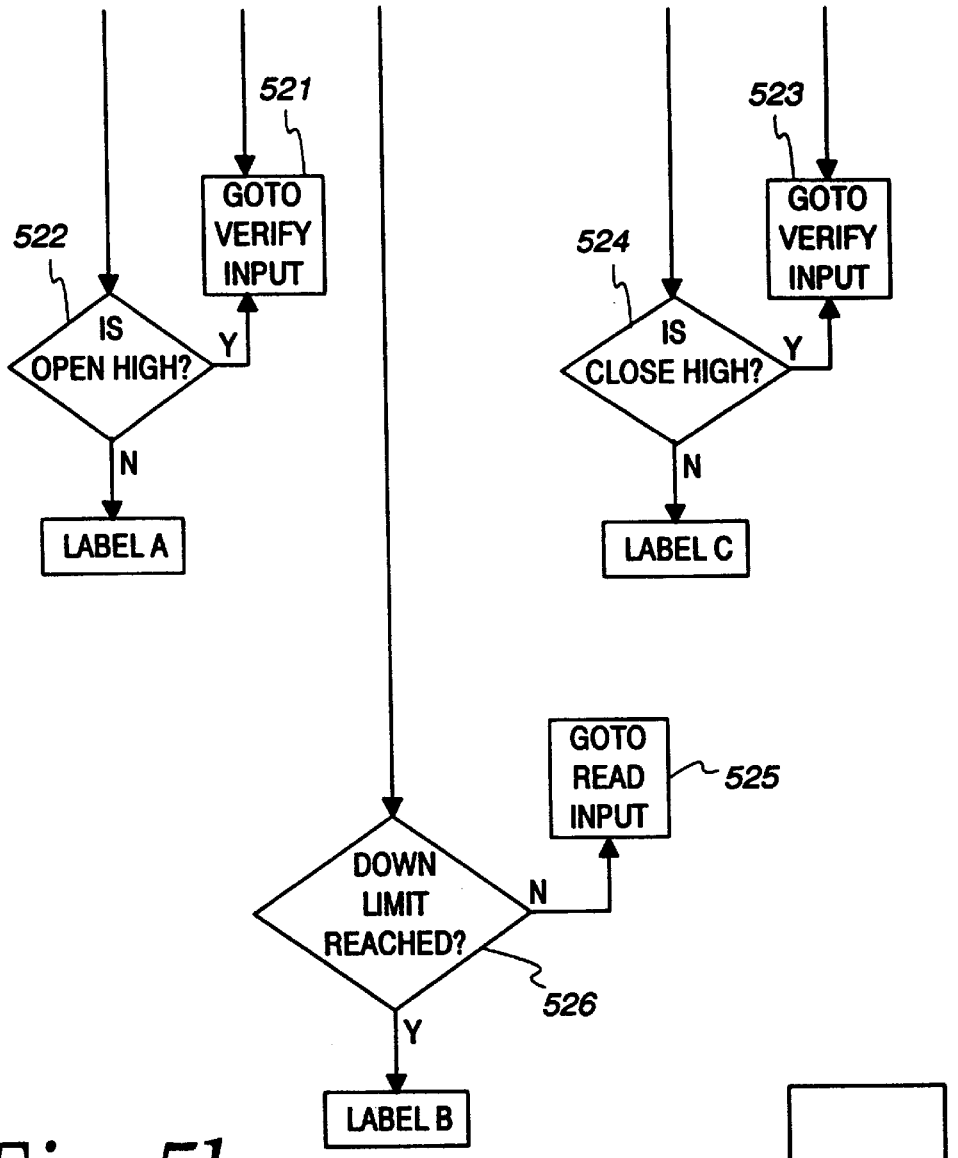
Fig. 5b
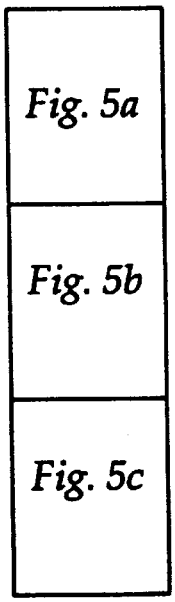

FIRE DOOR OPERATOR HAVING AN INTEGRATED ELECTRONICALLY CONTROLLED DESCENT DEVICE

MICROFICHE APPENDIX

This application includes, pursuant to 37 C.F.R. 1.77(c)(2) and 37 C.F.R. 1.96(b), a microfiche appendix consisting of four sheets of microfiche containing 41 frames of a listing embodying aspects of the present invention.

BACKGROUND OF THE INVENTION

This invention relates to fire door operators, and more particularly, to a fire door operator having an integrated electronically descent control device.

Commercial doors come in a variety of configurations: rolling steel (jackshaft driven), overhead sectional (trolley driven), store front grilles (jackshaft driven), fire doors (jackshaft driven) and so on. A fire door is a specially designed commercial door which is placed in strategic locations throughout such places as factories, hospitals and schools to prevent the spread of fire through a building. In the event of a fire, the fire door closes automatically, sealing off protected areas and preventing further spread of the fire.

The most basic version of a fire door system is a fire door coupled to a door sprocket. The sprocket includes a sprocket assembly having a fusible link that normally engages a sprocket to hold the door open. In the event of a fire, when the sprocket assembly reaches a critical temperature, the link softens or melts and releases the sprocket. The door springs to close and begins to descend in the downward direction. U.S. Pat. No. 4,147,197 to Bailey et al. describes a fire door with only a fusible link for enabling closure.

A controlled descent mechanism usually prevents the door from rapidly running uncontrolled into the floor due to acceleration from gravity. Frequently, the controlled descent mechanism is a mechanical assembly, such as a viscous clutch or governor, that prevents the door from exceeding a maximum or runaway speed. An example of a fire door system having an integrated viscous clutch assembly can be found in U.S. Pat. No. 5,203,392 to Shea. Shea discloses a mechanism for controlling the raising and lowering of a fire door in which a pneumatically or hydraulically operated governor is mounted on an input shaft for limiting its rotational speed before it drives the speed reduction gearing driving the output shaft.

In addition to being operated as a fire door, some fire doors need to be operated as regular commercial doors, requiring opening and closing through a more conventional door opener system. Commercial door openers typically include a motor, a gear reduction system and an electronic control package for automatically opening and closing the door. The single operation system of many fire doors, in which the fusible link must be replaced after closing, is not suitable for such dual use.

More importantly, fire doors must be tied into the building smoke and fire alarm systems. In the event of a fire, smoke alarms can provide an earlier indication that the fire door should be closed than a purely mechanical system. In a purely mechanical system, the ambient temperature must reach a very high level to melt the fusible link before the door descends. In a fire door system connected to a smoke or fire alarm system, the fire door can be programmed to descend upon receipt of a fire alarm signal, before melting of the fusible link.

Many fire door openers are powered by AC motors. AC motors are generally lower in cost because of their higher use than DC motors. Additionally, use of an AC motor means the opener can be driven by the line voltage without any expensive DC rectification or conditioning circuitry. The major disadvantage of an AC motor, however, is they it cannot drive the system in the event of a power outage. Also, the AC brake solenoid in the reverse brake system, releases in a power outage, causing the door to drop when there is no alarm condition. Such AC motor systems are generally used in applications where the normal condition of the door is closed (normally closed or NC).

In situations where the fire door is normally opened, or remains open for significant periods of time, some fire door operators are powered by a DC motor with battery backup. If the door needs to be opened or closed during the AC power outage, the operator can be operated with the battery backup. However, DC motor systems are more expensive than AC motor systems and, in the event of a failure of the battery backup system, the unit still requires a controlled descent device, if it has a fail safe brake.

U.S. Pat. No. 5,245,879 to McKeon describes a fail-safe fire door release mechanism having automatic reset. Fail-safe operation, in the industry, means the fire door will close in the absence of power, which frequently precedes a fire. McKeon is also concerned with having a fire door that can be automatically reset in the event of a power outage. McKeon's fail-safe mechanism includes a solenoid for activating a brake. In the absence of power, the solenoid is open and disengages the brake; in the presence of power, the brake is closed and engages the brake. Thus, when power is lost (whether or not there is a fire alarm), the brake is released allowing the door to close. Door descent speed is controlled by the governor arrangement described in the Shea patent. While McKeon provides for fail-safe operation, the door always closes during a power outage.

There is a need for a fire door operator which can be driven by a low cost AC motor during normal door operation. There is also a need for a fire door operator which can reliably close the door during an alarm condition during a power outage. There is a need for a fire door operator which does not inadvertently release the door during a power outage unless there is a fire or an alarm condition. There is also a need for a fire door opener which controls the descent of the door electronically, without the added cost of an expensive viscous clutch. There is a further need for a fire door which is user configurable for alarm contact type, descent speed and time-to-close delay.

SUMMARY OF THE INVENTION

To achieve the foregoing and other objects, a fire door operator embodying to the present invention includes a DC brake solenoid coupled to an AC motor drive system with an inline gear reducer. If AC power is lost, the brake can be controlled by an electronically controlled descent device and the battery backup power. If the brake is disengaged, the door will drop by overcoming the internal inertia and friction in the inline gear reducer. More particularly, an electronically controlled descent device for controlling the speed of descent of a fire door in response to a close command includes a DC solenoid which engages and disengages the brake holding the fire door. A sensor detects the descent speed of the fire door as it drops. An electronic controller, responsive to the speed sensor, selectively disables the DC solenoid when the descent speed reaches a predetermined maximum speed and enables the DC solenoid when the descent speed reaches a predetermined minimum speed. The operator can be operated using either normal DC solenoid logic (a high signal releases the brake) or fail safe logic (a low signal releases the brake).

A method for electronically controlling the descent speed of a fire door without AC power or motor control is also described. Without AC power, the unit electronically releases a DC solenoid brake. The weight and spring tension of the door cause the door to descend. Speed of descent is controlled electronically by measuring the speed of the output sprocket of the drive shaft of the fire door and electrically modulating the brake engagement. An electronic control circuit, which operates on the DC battery backup power, selectively enables and disables the DC solenoid based on detected door speed. If the fire door closing or descent speed exceeds a predetermined threshold, the electronic control circuit enables the DC solenoid, which engages the brake. The brake then slows the fire door. As fire door speed decreases, when it reaches a predetermined minimum speed, the electronic control circuit disables the DC solenoid and the brake is released. The electronic control circuit continues to modulate the brake engagement and disengagement until the fire door reaches its closed or final position.

Since proper maintenance requires load testing and battery charging of the battery backup system, an integrated means to monitor, charge and test the batteries is provided. When batteries are low and in need of replacement, an audible or light warning may also be provided.

The fire door operator also includes circuitry such as simple switch or jumper settings which enable the user to make field selections, depending on the type of door and external alarm system available, to control the type of alarm contact, maximum door descent speed, and time-to-close delay. For example, since the alarm system is independent of the fire door operator unit, the alarm contact type depends on the nature of the alarm system output relay. Some doors are normally open; others are normally closed. When there is an alarm condition present, the alarm system changes the state of its NO (normally open) or NC (normally closed) contact.

Preferably, the door should not exceed a predetermined maximum speed when it is descending without AC power. The maximum speed allowed varies, depending on door type, reduction sprockets and other factors. To enable user selection of the maximum DC descent speed, field selectable switch or jumper settings may be provided.

The timer to close is defined as the time delay between the time when the unit first receives an alarm condition and when the unit starts to close the door. The time delay is used, often in combination with audible and visual warnings of imminent door closure, to enable users to exit the area to be shut off when the door closes. Field selectable switch or jumper settings may be provided to enable changing the time-to-close delay.

BRIEF DESCRIPTION OF THE DRAWINGS

FIGS. 5A, 5B and 5C are a flow chart of a logic control board for use in a fire door operator shown in FIG. 1;

DETAILED DESCRIPTION OF THE PREFERRED EMBODIMENTS

Figure 1:
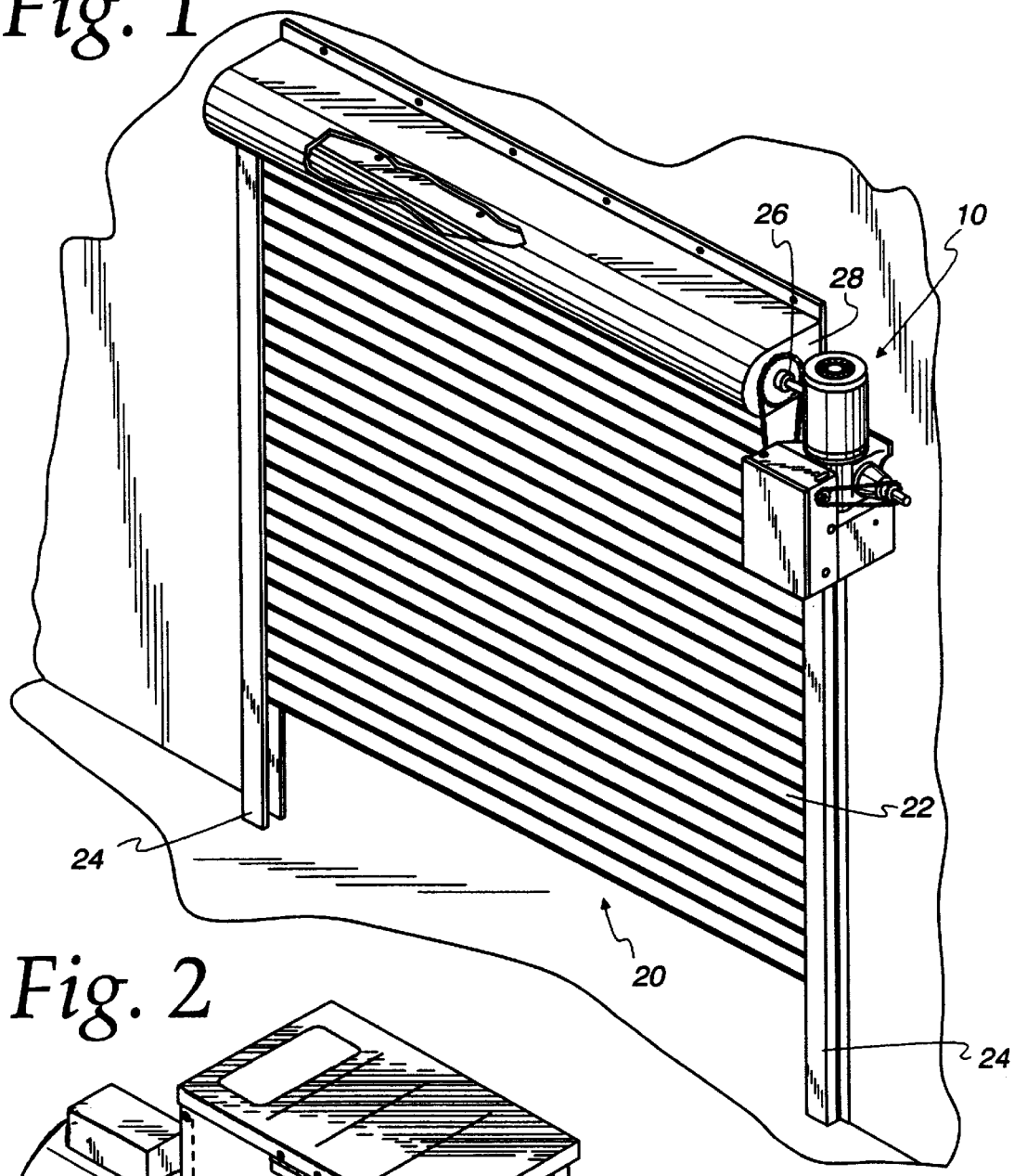
FIG. 1 is a perspective view of a rolling fire door system having a fire door and a fire door operator, the fire door operator embodies the present invention.

Referring now to the drawings and especially to FIGS. 1, 2, 1A 2A and 6, a fire door operator embodying the present invention is generally shown therein and identified by reference numeral 10. The fire door operator has a DC solenoid 632 coupled to be controlled by a speed sensor 626 for detecting the descent speed of a fire door 20. An electronic control circuit 642 is connected to the speed sensor 626 and to the solenoid 632.

Jackshaft driven fire door 20 includes a rolling door curtain 22 including a plurality of interconnected, pivotal slats. A pair of vertical guides 24 guide the vertical movement of the slats inside the guides to a first or open position and to a second or closed position. As shown in FIG. 1, fire door 20 is in an open condition. The top of curtain 22 is fixed to a horizontally rotatable door shaft 26. Fire door operator 10 is coupled to door shaft 26 for winding and unwinding curtain 22 around door shaft 26 to respectively open and close the fire door 20. Typically, the door shaft 26 is enclosed in a housing 28, which is sized to hold the curtain in the fully open position.

Figure 1B:
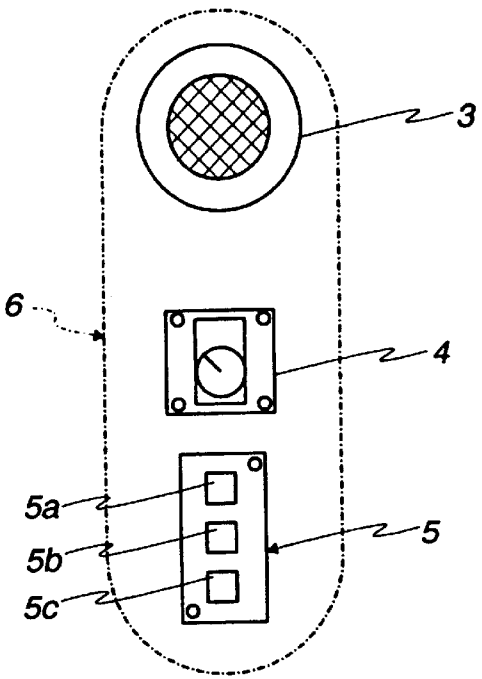
FIG. 1A is a front view of the fire door and fire door operator of FIG. 1.
Figure 1A:
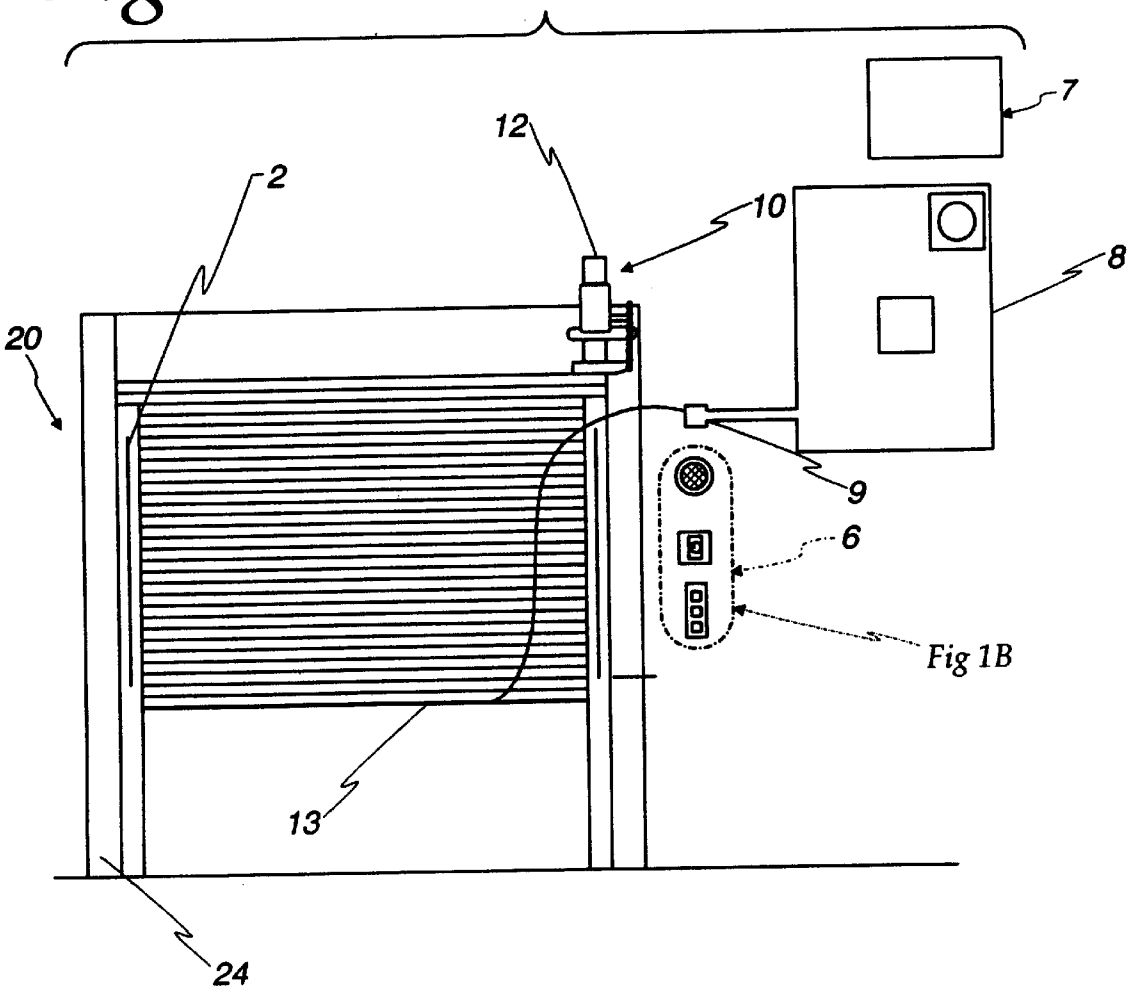

Additional features of the fire door operator of FIG. 1 are shown in FIG. 1A. From this view can be seen an independent alarm system (or smoke detector) 7 which is coupled electrically to a control panel 8. Control panel 8 also has a battery backup (not shown) for operating the fire door operator in the event of a power failure. In this example, motor unit 12 is preferably a one half horsepower AC motor. Junction box 9 provides AC power to operate unit 12 as well as for charging the battery backup system in control panel 8. Key station 6 includes speaker 3 for providing audible warnings in the event of an alarm, reset key switch 4 for testing the system simulating an alarm condition and push button station 5 for controlling normal operation of the door 20. Control station 5 includes three buttons: open 5A, close 5B and stop 5C. Warning lights 2 are provided in the guide rails for warning persons of imminent door closure. Many types of obstruction detection systems are available to prevent closure on an obstruction. Reversible safety edge 13 stops and reverses the door in the event an obstruction is detected. In the alternative, an IR light system or other obstruction system can be installed for detecting obstacles in the path of the door. Further details of the operation of the fire door system are described with reference to FIGS. 5A–5C.

Figure 7A:
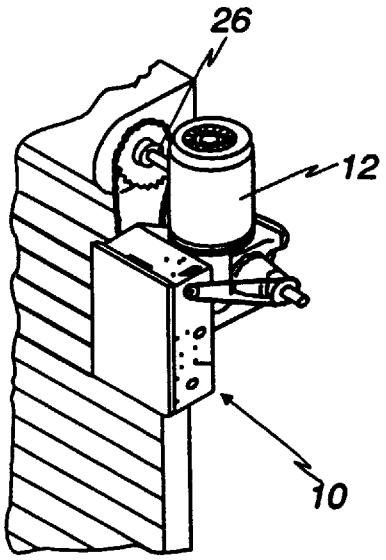
FIG. 7A is a perspective view of a fire door operator shown in FIG. 1 and mounted to wall.
Figure 7B:
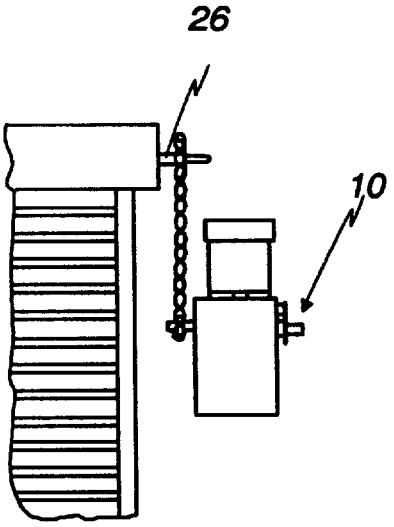
FIG. 7B is a front view of the fire door operator shown in FIG. 7A.
Figure 7C:
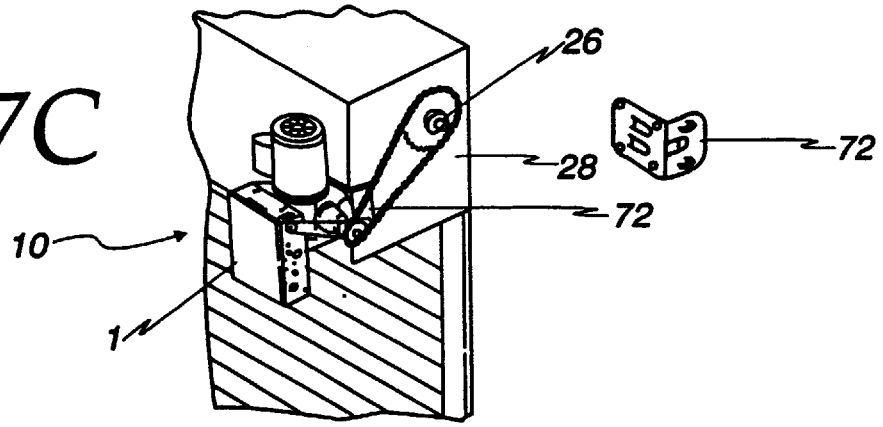
FIG. 7C is a perspective view of a fire door operator shown in FIG. 1 and connected to a fire door curtain housing.

As shown in FIGS. 7A and 7B, fire door operator 10 may be mounted to the wall in a vertical position (with the motor 12 shown at the top). Alternatively, fire door operator 10 may be mounted to housing 28 as shown in FIG. 7C via a bracket 72. Horizontal mounting to housing 28 is also possible.

Figure 2:
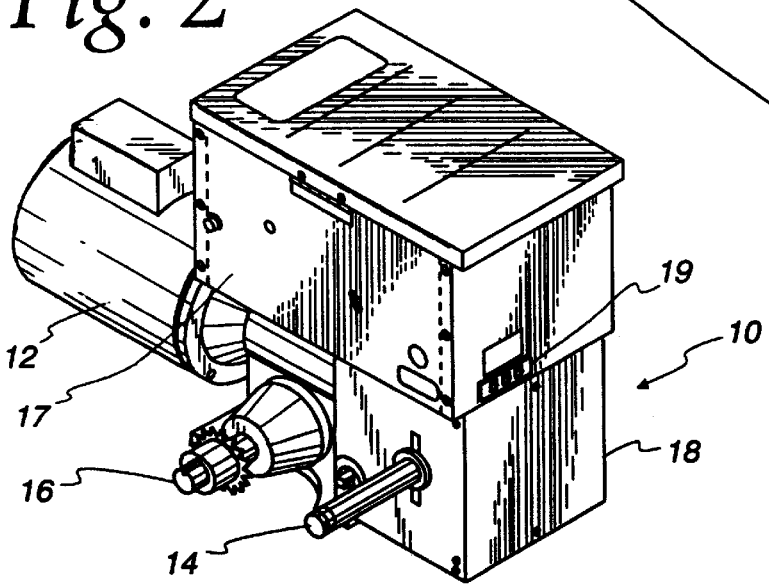
FIG. 2 is a perspective view of the fire door operator shown in FIG. 1.
Figure 2A:
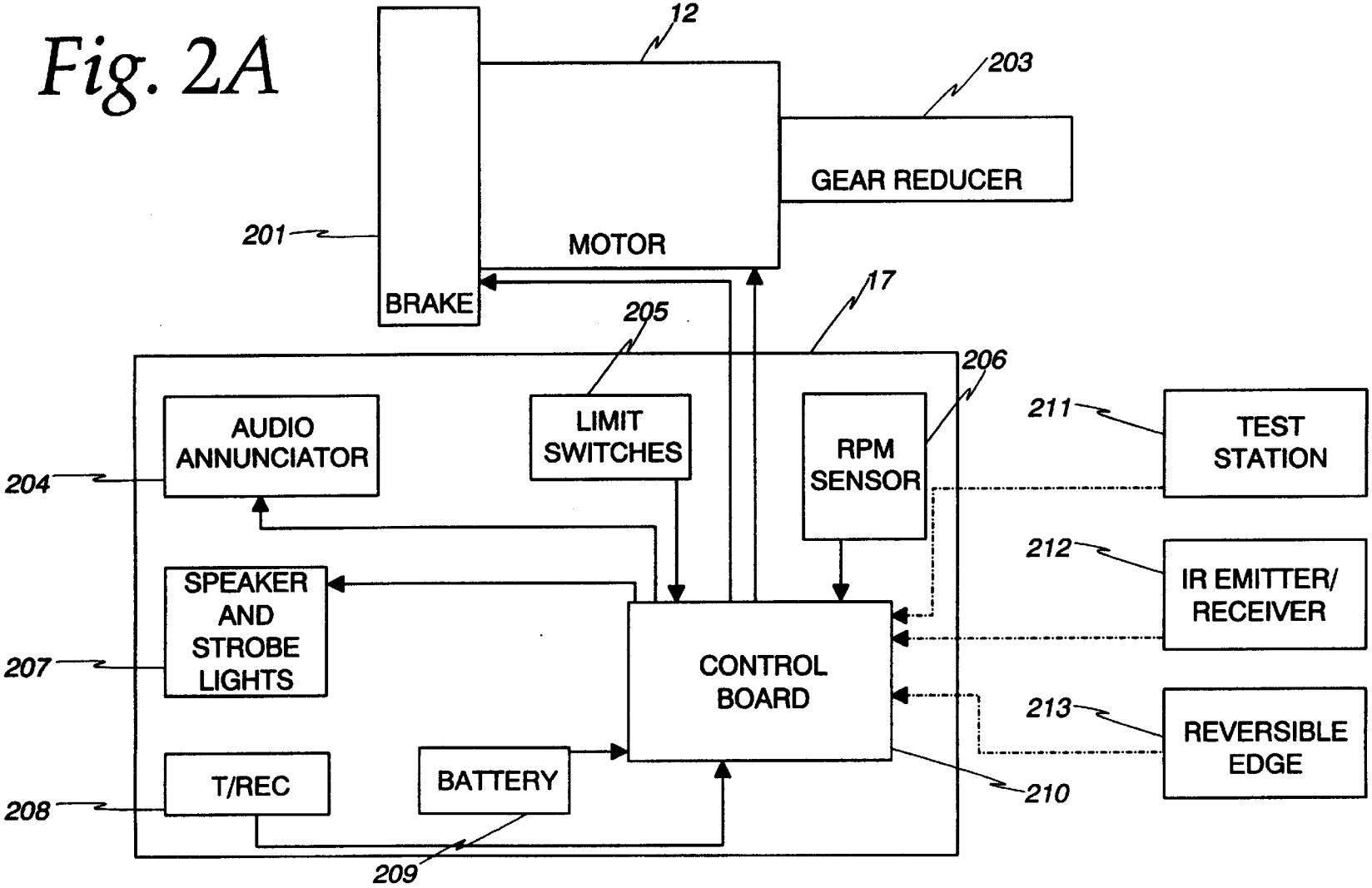
FIG. 2A is a block diagram of the elements of the fire door operator shown in FIG. 2.
Figure 3A:
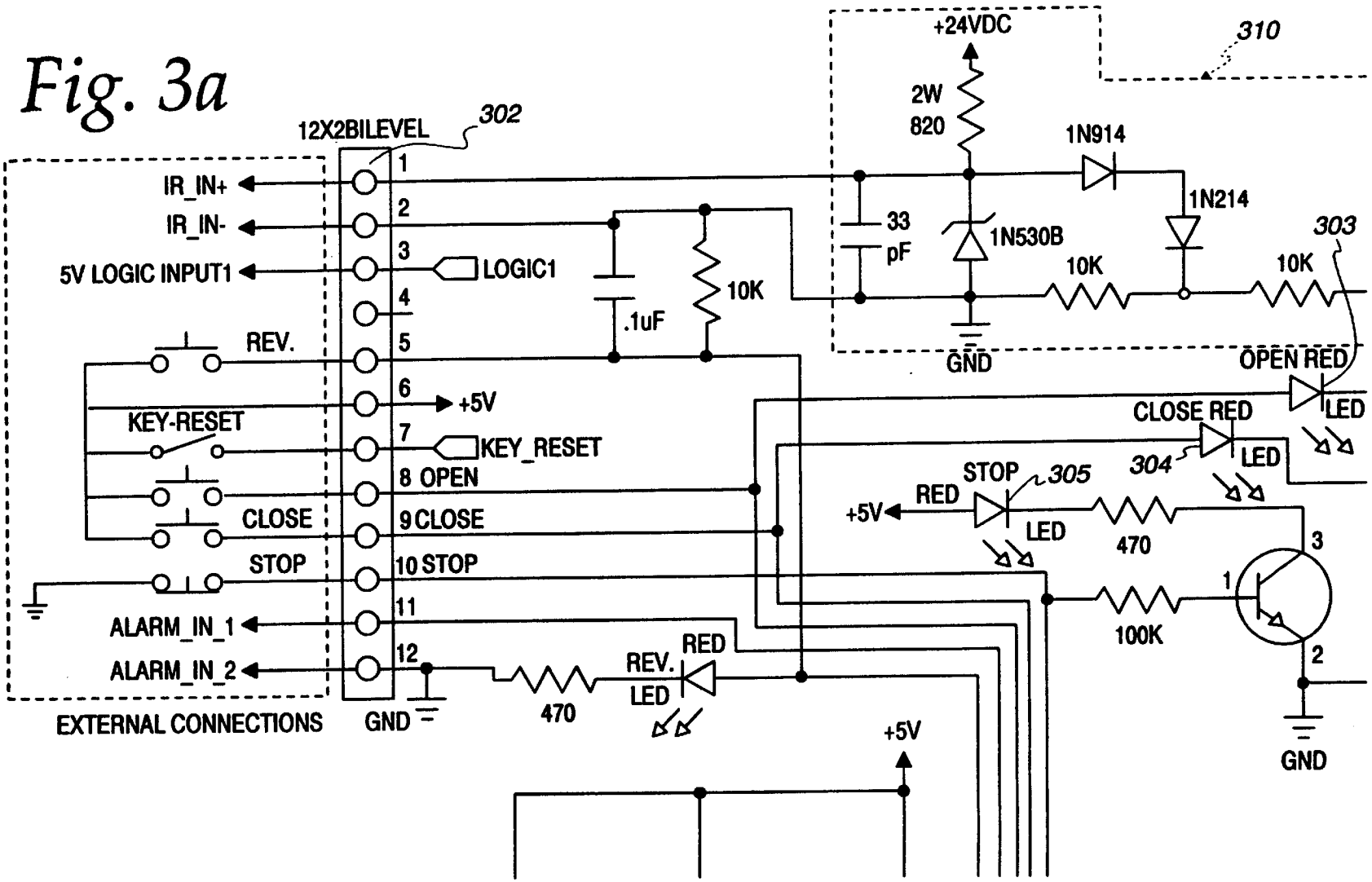
FIGS. 3 and 4 are circuit diagrams of the electrical connections to a programmable logic board for a fire door operator shown in FIG. 1.
Figure 3B:
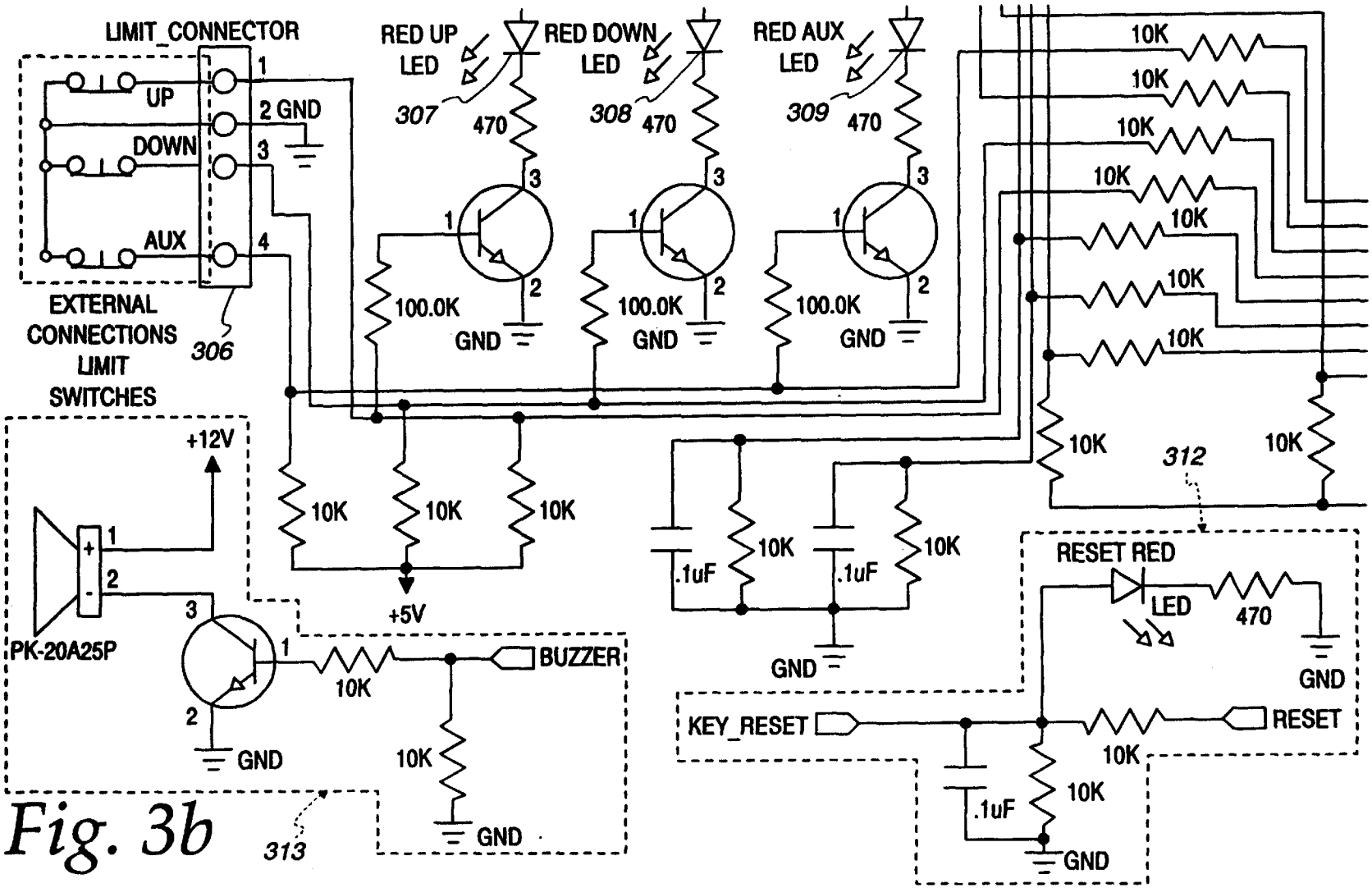
Figure 3C:
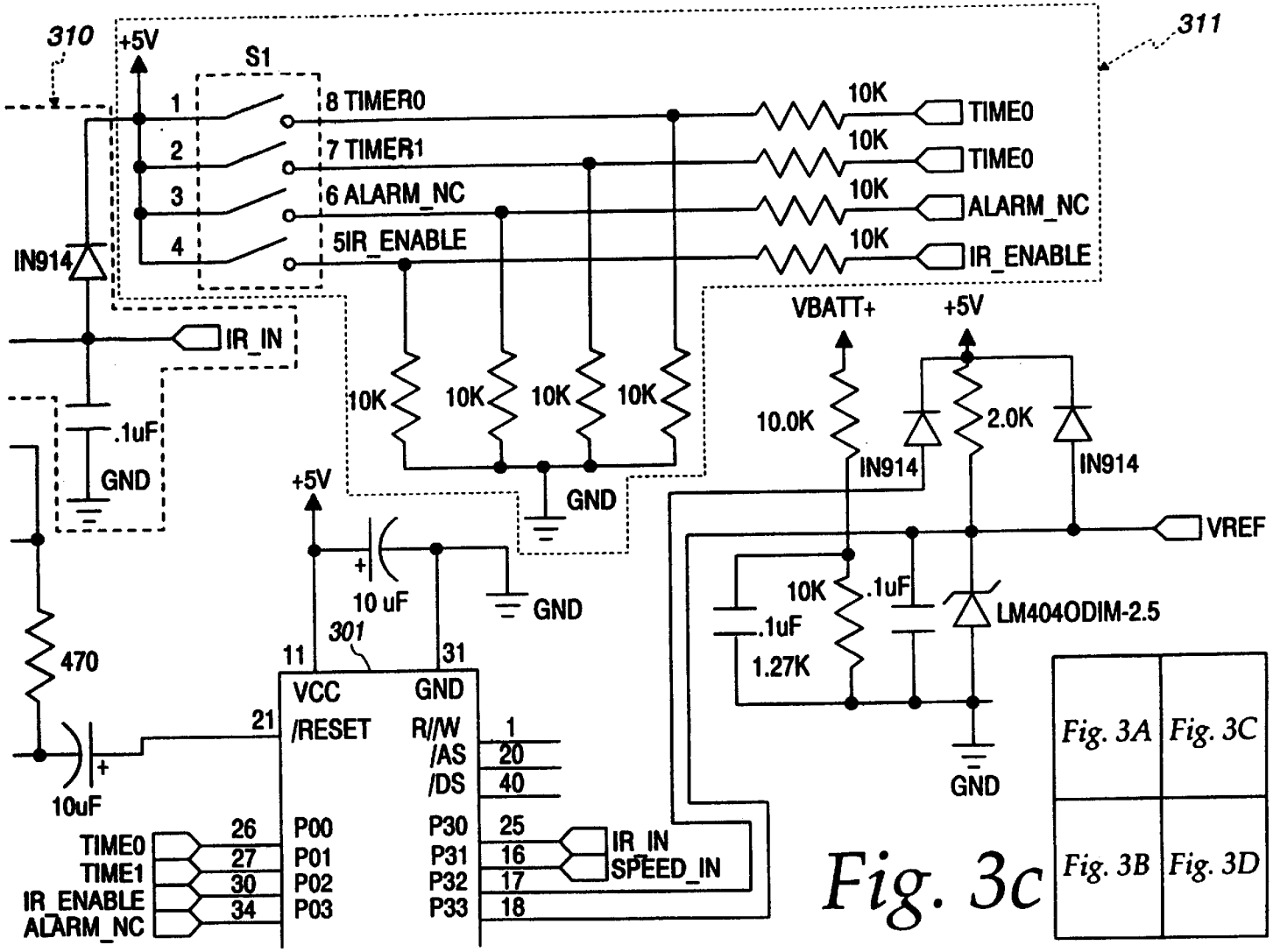
Figure 3D:
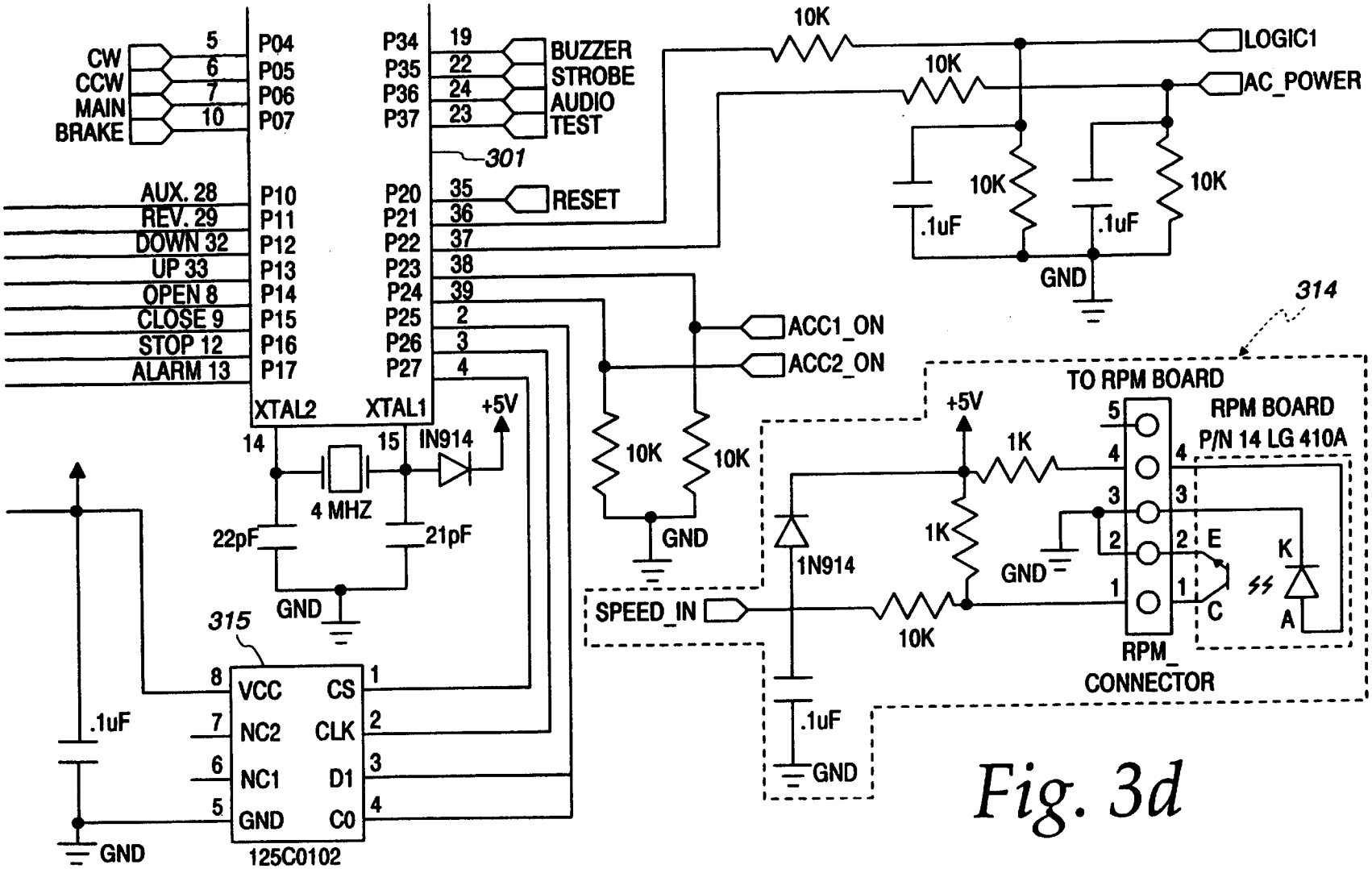
Figure 4A:
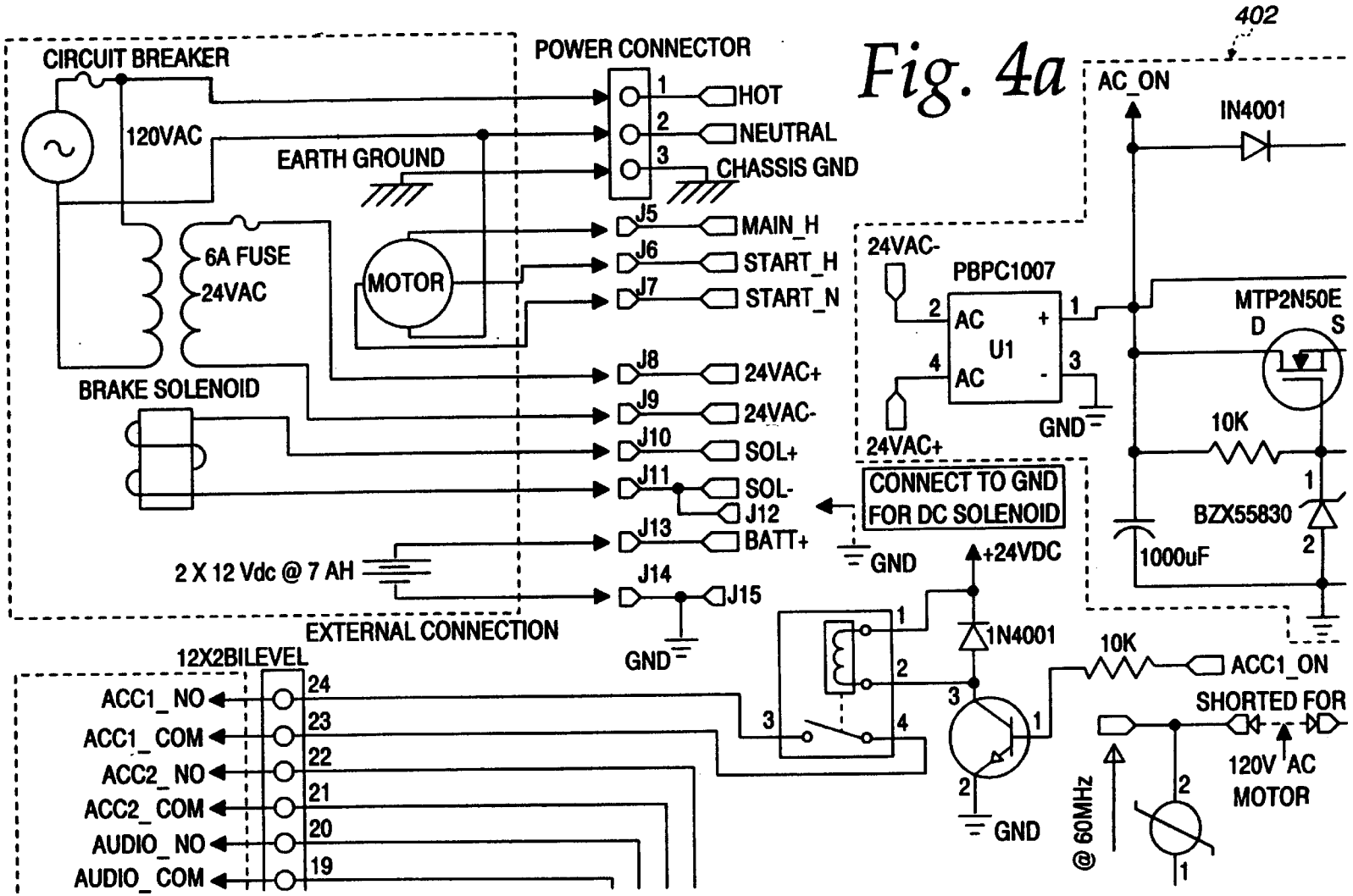
Figure 4B:
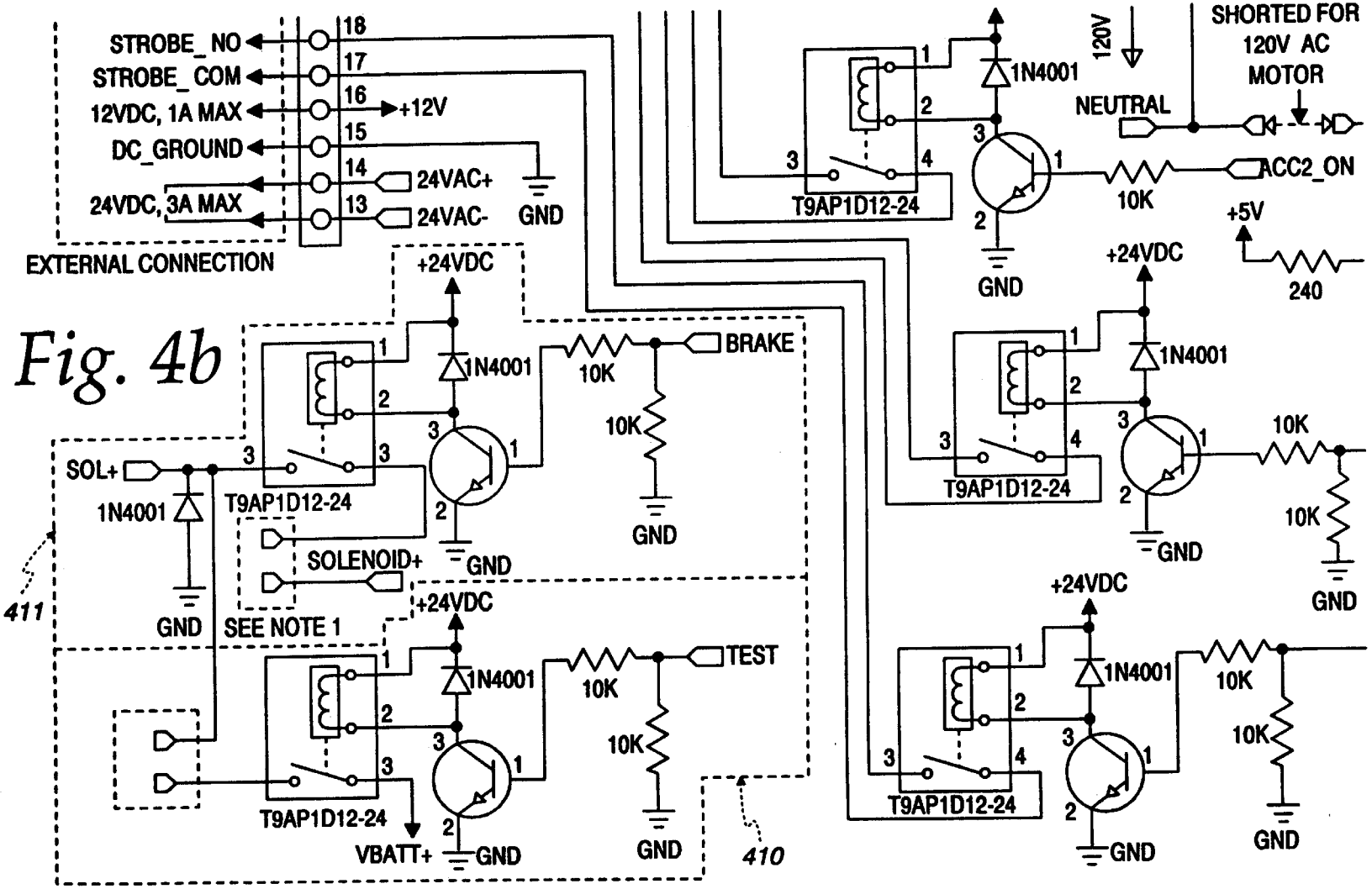
Figure 4C:
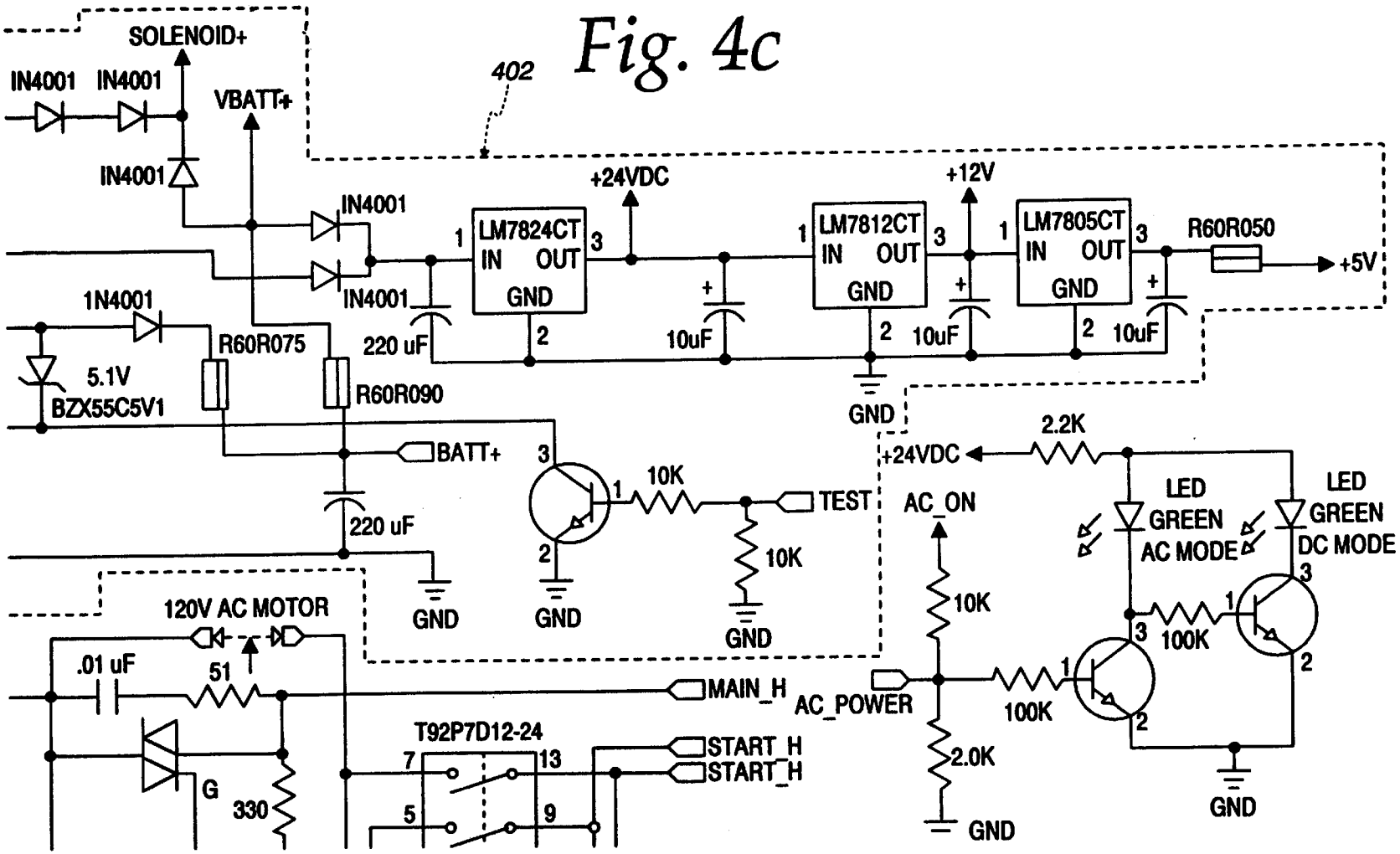
Figure 4D:
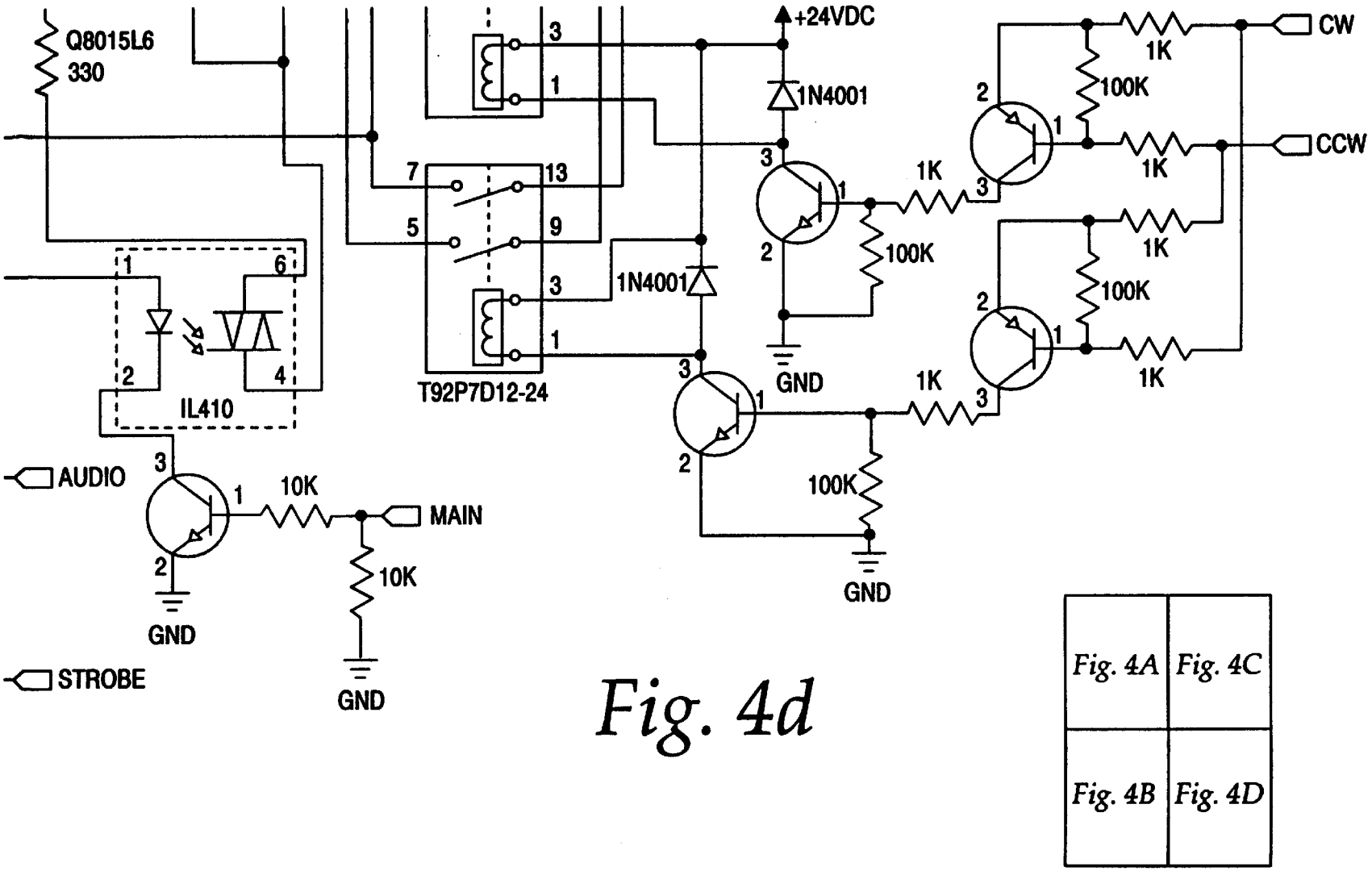

FIG. 2 shows a perspective view of fire door operator 10 in FIG. 1. Motor 12 drives input shaft 14, which is coupled to output shaft 16 through a gear reduction system (not shown). Electrical control box 17 houses the programmable logic board which controls the descent speed of the fire door 20 in the event of an AC power outage. Referring to FIG. 2A, a block diagram of the fire door operator 10 and optional systems is shown. Brake and solenoid 201 are coupled to motor 12, which is coupled to linear gear reducer 203. The electrical box 17 includes audio annunciator 204, limit switches 205, RPM sensor 206, speakers and strobe lights 207 and control board 210. Transformer and rectification module 208 provides the main power to the operator 10. In this embodiment, battery bank 209 is shown installed in electrical box 17. Optionally, the battery backup could be a separate wall mounted box. Accessories available are the test station 211, IR emitter/receiver 212 and reversible edge detector 213.

Figure 6:
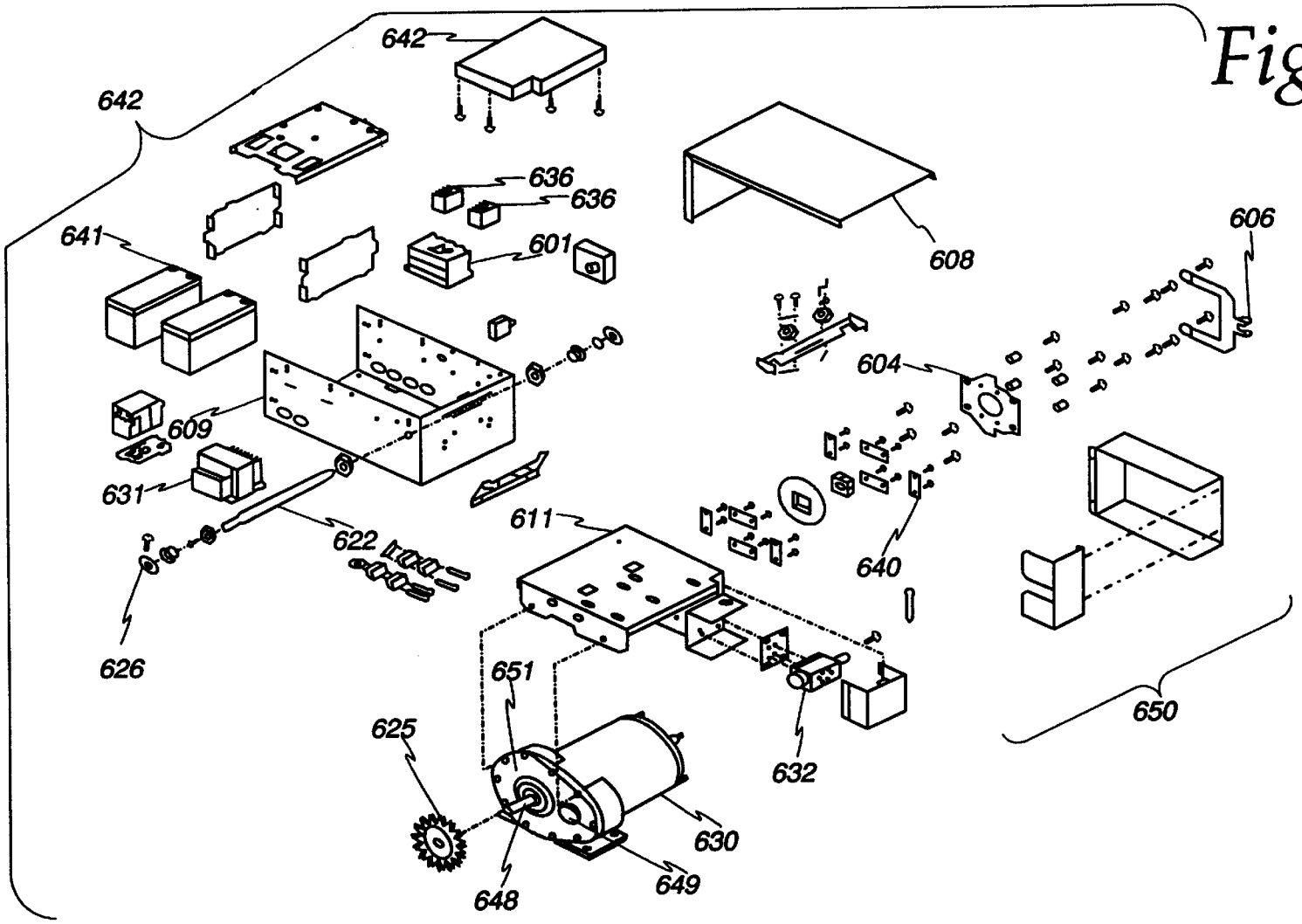
FIG. 6 is an exploded perspective view of the fire door operator of FIG. 2.

FIG. 6 is an exploded perspective view of the fire door operator of FIG. 2. Dual sprocket 625 is attached to the end of output shaft 648. Input shaft 622 fits into opening 649 of cover 651. The brake box houses the brake solenoid 632, and brake assembly 650. Brake solenoid 632 engages and disengages brake assembly 650 comprising brake pressure plate 604, brake release lever 606 and brake pads 640. Upon enablement of the brake solenoid, brake assembly 650 acts on output shaft 648 to reduce its rotational speed. Electrical box 19 includes cover 608 and enclosure 609 and houses transformer 631, batteries 641, programmable logic controller board 642, contactor 601 and contact blocks 636.

Figure 5A:
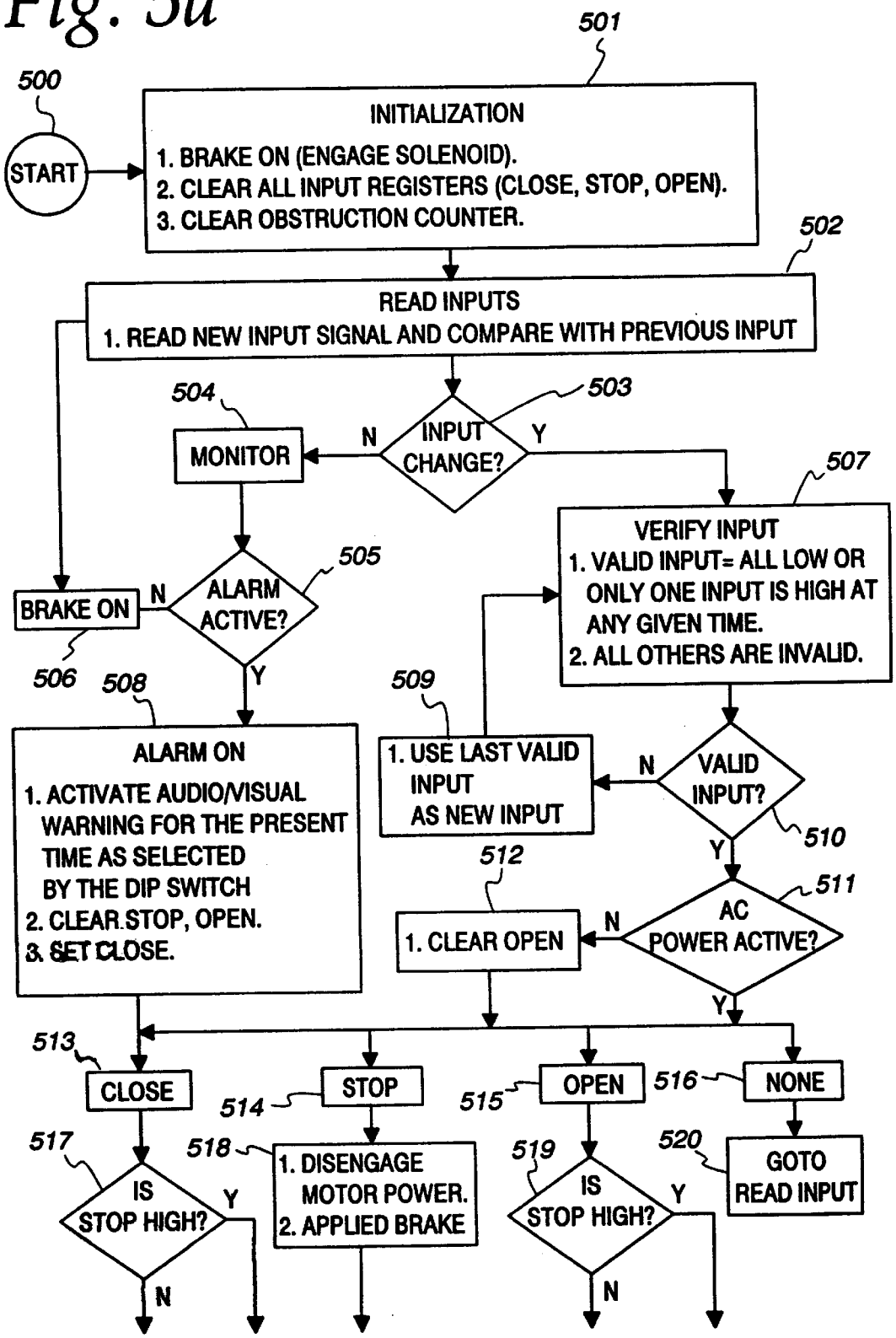
Figure 5C:
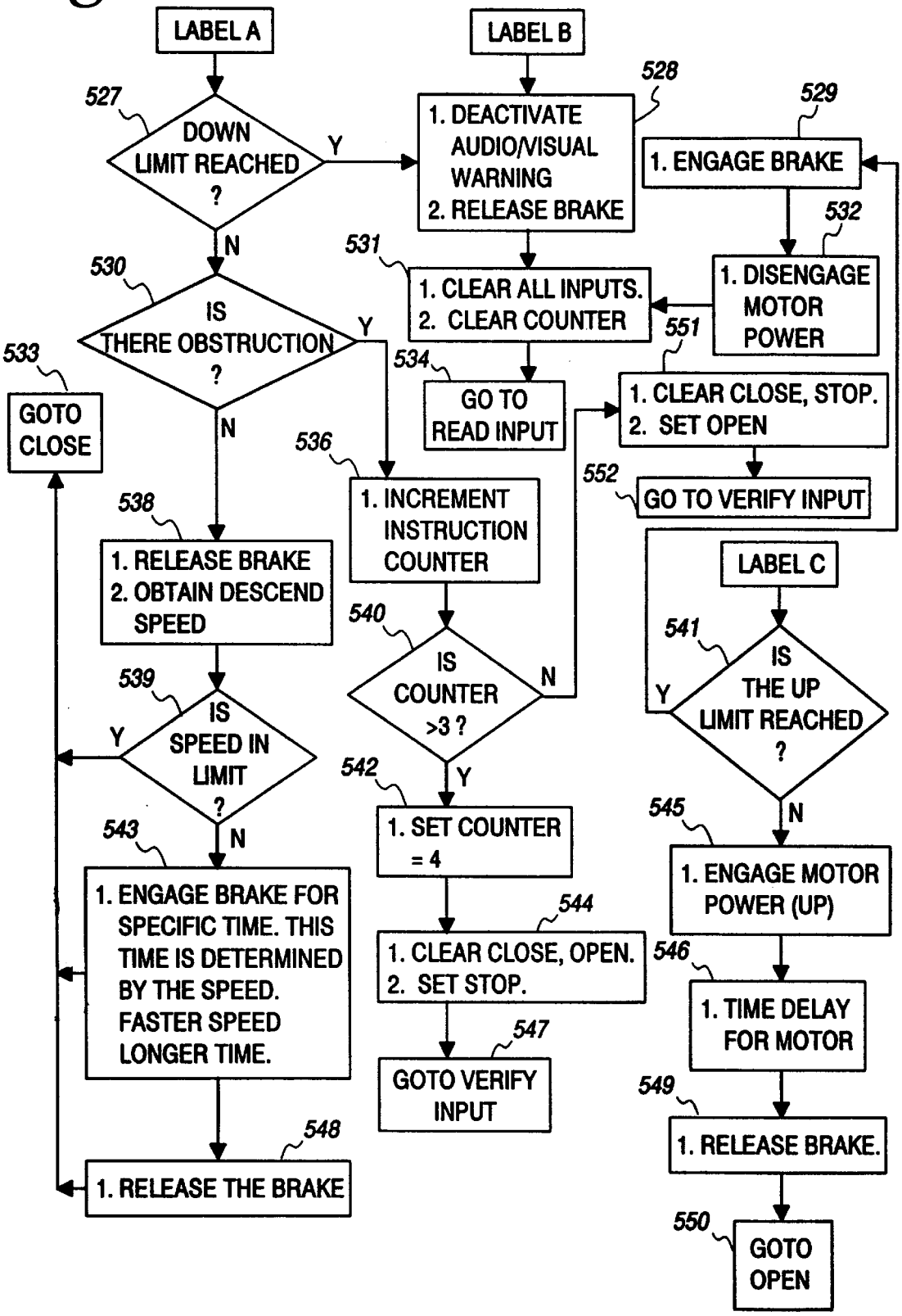

Operation of the programmable logic controller is shown in the flow chart of FIGS. 5A, 5B and 5C. The controller starts operation at Step 500, after power is applied to the system. In Step 501, the controller goes through an initialization step in which the brake is on (the solenoid is engaged), all input registers are cleared (close, stop and open) and the obstruction counter is cleared. In Step 502, the controller reads all new input signals and compares them (Step 503) with any previous input signals. It there are no changes, the controller branches to Step 504 where the system goes to a monitor condition. In Step 505, the controller checks for an active alarm. If the alarm is not active, it checks for brake (Step 506) then returns to Step 502.

Returning to Step 505, if the alarm is on, the controller continues to Step 508. If the alarm is on, i.e. an alarm signal is received form the external alarm system or smoke detector, the controller activates the audio/visual warning system. The audio/visual warning in the form of buzzers or recorded messages and flashing lights lasts for the period of time pre-selected by the user through one of the dip switches 19. Stop and Open are cleared and Close is enabled.

The Close routine begins at Step 513. In Step 517, if the output of the Stop gate is high, in Step 521, the controller branches back to Step 502. If the output of Stop is low, it continues to step 522 to check if the output of Open is high. If Open is high, in Step 521, the controller branches back to Step 507, Verify Input. If Open is low, the controller continues to Step 527 to check if the down limit has been reached. If the down limit has not been reached, the controller checks at Step 530 for an obstruction. If there is no obstruction, the controller releases the brake in Step 538 and detects the descent speed. In Step 539, the controller measures the descent speed of the door. If the speed is within the predetermined limits, it branches back to Step 513. If the speed is not within the predetermined limits, it continues to Step 543. In Step 543, the controller engages the brake for a specific time determined by the speed of the door; the faster the door speed, the longer the engagement time. At the end of the time period, the controller releases the brake at Step 548 and then branches back to Step 513.

Returning to Step 530, if there is an obstruction, the controller branches to Step 536. In Step 536, the controller increments the instruction counter. If the counter is greater than 3 (Step 540), the controller sets the counter to 4 (Step 542), clears Close and Open and Sets Stop (Step 544) then branches at Step 547 to Step 507, Verify Input. If the counter is less than 3, the controller branches to Step 551 where it clears Close and Stop and Sets Open. Then at Step 552, the controller branches back to Step 507, Verify Input. In the foregoing, the controller has been programmed to allow the door to descend and check for the obstruction three times. Each time, the door reverses and opens. On the fourth time, the door is set to Stop just above the obstruction. The number of times the controller checks for an obstruction can be varied depending on user requirements.

Returning to Step 527, if the down limit has been reached (the door has reached the floor or other closed location), the controller branches to Step 528 where it deactivates the audio/visual warning system and releases the brake. Next in Step 531, the controller clears all inputs and clears all counters. In Step 534, the controller returns to Step 502, Read Inputs.

Returning to Step 503, if the input has changed, the controller branches to Step 507, where it verifies the input. A valid input is determined if all of the commands (Stop, Close, Open and None) are low or only one of the four is high. All other inputs are invalid. In Step 501, if the input is not valid, the controller branches to Step 509 and uses the last valid input as the new input and returns to Step 507. If the new input is valid at Step 510, the controller continues to Step 511 to check if AC power is available. If AC power is available, it branches to the Stop, Open, Close or None command. If AC power is not active, at Step 512, the controller clears Open.

The Close routine at Step 513 has already been described above. The None routine at Step 516 just sends (Step 520) the controller back to Read Input, Step 502.

Step 514 begins the Stop routine (after a user selects the Stop command at button commands 5. In Step 518, the motor power is disengaged and the brake is applied. If the down limit has not been reached, the controller branches at Step 525 to Step 502 Read Input, leaving the door stopped at its current location. If the down limit has been reached (Step 526), the controller continues to Step 528 where the audio/visual warnings are deactivated (they would not be activated in a normal Stop command) and the brake is released. Then in Step 531, all inputs and counters are cleared. And in Step 534 the controller returns to Step 502, Read Input.

Step 515 begins the Open routine. First the controller checks for Stop high. If yes, it branches at Step 523 to Step 507 to Verify Input. Then it checks for Close high. If yes, it branches at Step 523 to Step 507, Verify Input. If not, the controller continues to Step 541 and checks for the up limit. If the up limit has not been reached, at Step 545, the controller engages the motor. To enable the motor to develop sufficient power to move the door, a time delay is programmed into the system. At Step 546, after the expiration of the time delay, the brake is released and the door begins moving up. The controller then branches at Step 550 back to Step 515, Open. If the up limit has been reached at Step 541, the controller engages the brake at Step 529, disengages motor power at Step 532, clears all inputs and counters at Step 531 and branches at Step 534 to Read Input, Step 502.

Operation of the fire door operator is controlled by a programmable logic board. Referring to FIG. 3, programmable logic board includes microcontroller 301, which may be a Zilog brand Z86E40 with 4K of ROM on board. External connections for some of the optional controls are made through terminal block 302. Inputs for IR eyes (Ir_IN+ and IR_– at pins 1 and 2), 5V Logic Input1 at pin 3. The B2 button control switches are also wired into block 302: Reverse at pin 6, Key-Reset at pin 6, Open at pin 8, Close at pin 9, Stop at pin 10. The external alarm system is input at pins 10 and 11.

The output of the external IR obstruction detector at terminal block 302 is applied to IR circuit 310, which applies signal IR_IN to pin P30 of microcontroller 301 and is also coupled to timing circuit 311. Open, Close and Stop signals are applied to pins P13, P14, P15 respectively of microcontroller 301. Additionally, LED lights 303, 304, 305 respectively are lit when the respective button is pushed.

External limit switch circuitry is applied to terminal block 306. The Up and Down limits are input from terminals 1 and 3, respectively of block 306, then applied to pins P11 and P12 of microcontroller 301. Lights 307, 308 and 309 are lit when the Up, Down or Aux switches have been met.

Buzzer circuit 313 emits a warning sound when energized by pin P34 of microcontroller 301 after the battery test circuitry 410 indicates a low battery.

An external alarm signal from pin 11 of block 302 is applied to P17 of microcontroller. During an alarm, the various counts are stored in EEPROM 315. The output of the RPM sensor circuit 314, SPEED_IN, is applied to pin P31 of microcontroller 301. The output of RPM Board 316 is applied to RPM connector 317. RPM board 316 measures the speed of the limit sprocket on the output shaft. Brake signal inputs from microcontroller 301 are applied via BRAKE to circuit 411 which enables and disabled the solenoid, which then engages and disengages the brake.

Referring to FIG. 4, circuit 401 shows the external electrical connections for the motor, brake solenoid and transformer. Circuit 402 takes AC power and rectifies it to DC. Other audio, visual and auxiliary connections can also be made.

EXAMPLE SPECIFICATIONS

A specific example of a preferred fire door operator includes a removable, continuous duty AC motor with overload protection and the following specifications. Half horsepower and one horsepower models operating at 115 volts (single phase), 230 volts (single and three phase) and 460 volts (three phase) at 31 revolutions per minute are generally suitable for use with the fire doors contemplated. The output shaft to limit shaft preferred ration is 1 to 2.11 with a maximum limit shaft revolutions of 70.

A linear gear reducer has a preferred output torque of 800 inches/pound for the one half horsepower motor and 1300 inches/pound for the one horsepower motor. Maximum overload is 400 pounds at one inch for the half horsepower motor, and 800 pounds at one inch for the one horsepower motor. Sprocket sizes are 501B19 and 50B19 for the half and one horsepower motors, respectively, both with square key. Door sprocket is 50B32. Output shaft is ¾ inch and 1¼ inch for the half and one horsepower motors, respectively. Mounting is horizontal. The brake solenoid can be a DC solenoid rated at 24 volts DC or an AC solenoid rated at the line voltage used. Minimum break away torque is 144 inch pounds. The brake is rated at 720 inch pounds and 1440 inch pounds for the half and one horsepower motors, respectively.

A preferred power source for the system is 24 volts AC at 6 amperes with a 24 volt DC battery back up. The battery back up system can be a short life system which includes two 12 volt 0.8 ampere hour lead acid batteries (UL listed and flame retardant). Another battery back up system with extended life includes two 12 volt 7 ampere hour lead acid batteries (UL listed and flame retardant). The batteries are automatically charged whenever there is AC power present except when the unit is in the load test mode.

Relay Control Specifications

The programmable logic controller includes preferably six 24 volt DC 30 ampere NO (normally open) relays for external and internal devices. Two relays are used for battery test and DC solenoid control circuits. Two relays are used to control the audio and visual warning systems.

Preferably, two DIP switches are provided to enable the user to select the time to close. Delay times of 10, 20, 30 and 60 seconds are available. A third DIP switch is provided to enable the user to select OPEN=NO Alarm mode or CLOSE=NC Alarm mode. A fourth DIP switch is provided to enable an IR obstruction detection system with OPEN=IR disabled and CLOSE=IR enabled.

Descent Door Speed Control Specifications

Door speed is monitored (during loss of AC power) by a slotted optical sensor connected via a 5 pin plug-in connector. The optical sensor detects the rotational speed of a sprocket on the limit shaft. Normal speed is preferably 63 rpm. Excessive speed, maximum allowed descent speed, is defined as 70 rpm. The door speed control mechanism is only activated when the door is closing. If door speed exceeds 70 rpm, the brake is engaged in inverse proportion to the door instantaneous speed. The faster the door is traveling, the higher the duty cycle of the brake. The normal speed and excessive or maximum speed are software configurable.

Limit Switch Specification

Limit switches are used to set the maximum open and close travel for the door. Limit switches (Close, Open and Auxiliary) are NC (normally closed) switches and connected to the control board via a 4 pin plug-in connector. LED indicators are provided for each limit switch. If both Close and Open switches are activated, the microprocessor is reset.

B2 Switch Specification

The Open and Close buttons are NO (normally open) momentary switches. Stop is a NC momentary switch. LED indicators are also provided for each switch. If more than one button is pressed at the same time, the controller ignores the input (equivalent to pressing no buttons).

Reverse Edge Switch and Infra-Red Eye

Either the reverse edge or an IR system may be installed for obstruction detection. The activation of the reverse edge is equivalent to interrupting the IR eye's signal; both conditions indicate an obstruction exists. The reverse edge is a NO switch. It is disabled if the auxiliary limit switch is active. The IR eye must be enabled by activating the fourth DIP switch on the programmable logic controller. If the IR eye is not installed, the DIP switch must be disabled.

Key Reset

Key reset is a momentary NO switch. If the key reset switch is activated for at least six seconds, the unit will enter the alarm active mode. The unit will exit the alarm active mode if the Close limit is reached or two minutes have elapsed, whichever occurs first.

Alarm Mode

The external alarm system or smoke detector is connected to the controller's circuit board on screw-type terminals. Dip switch number 3 must be set to specify the alarm contact of NO or NC.

The warning system may include a speech board with speakers, which plays a recorded message warning of the door closure and a strobe assembly which flashes strobe lights prior to door closure.

Normal AC Operation

Preferably, the fire door operator includes a switch or other control to enable the door to be opened and closed normally. A typical normal open/close door control includes a three button station (open, close, stop) and wiring direct to the AC line voltage. Another one button key switch is used for testing the system. If the one button key switch is held for six seconds, it causes the alarm sequence to be activated for a two minute test period or until the down limit is reached. A reversing edge, if activated when the door is traveling down, causes the door to reverse to the up limit. If the edge is activated when the door is traveling up, the door stops. The brake is powered by a DC solenoid. If the DC solenoid is on continually, it keeps the brake engaged. The brake is disengaged when the door is in motion. The solenoid has a 12 hour battery back up, providing the batteries are fully charged. The battery back up is load tested once every thirty days. If the battery needs replacement, a unit mounted buzzer or warning light will sound or light once a minute for a three second duration.

Alarm Condition with AC Power

Upon receipt of an alarm condition (AC power present), the unit activates the audio and visual warning relays, if the door is not already closed. The alarm input sense (NO or NC) is user set by means of a dip switch on the unit. The audio/visual warning system play time is also user set by a dip switch to 10, 20, 30 or 60 seconds. Once the warning relays have been activated for the set time, the door will be closed. The strobe light remains on until the door is successfully opened. In the event of an obstruction, the door will reverse to the full open limit. The fire door controller will then reactivate the audio/visual relays for the set delay time and then closes the door. If the obstruction remains in place, the door reverses again to the full open limit and resets the audio/visual relays for the set delay time and then closes the door. Upon the third attempt to close the door, the system stops the door on the obstruction, then releases the brake after 2 seconds. If the obstruction is later removed, the unit performs a controlled drop of the door, not powered by the motor, using the internal inertia of the gear reduction system to slow the fall. If the reversing edge is activated while traveling up, the door will stop, then reactivate the alarm close sequence. Once the down limit is reached, the audio/visual relays are deactivated. The fire door controller will respond to the three button switch commands as a temporary override, but if left open, the system will reactivate the warning relays for the set time delay and attempt to close the door.

Loss of AC and No Alarm

When AC power is lost and there is no alarm condition, the "AC Power" light is switched off, leaving only the "DC Power" light lit. The unit loses B2 wiring functionality when AC power is lost. The DC brake remains engaged, holding the door open for up to 12 hours (the life of the fully charged batteries) unless the door is in the close limit. In the battery backup mode, the unit will automatically close the door if 12 hours have passed or low battery is detected, whichever occurs first. The door will not open until AC power is returned and the battery is charged above the minimum level.

If the close button is pressed, the unit releases the brake. The RPM sensor monitors the door's descent so that door speed does not exceed a predetermined maximum speed of 9 inches per second. If the door speed exceed 9 in/sec, the DC solenoid engages the brake. The brake stays engaged until the door speed slows to a predetermined minimum speed of 6 in/sec. The stop button is functional during door descent to halt travel (provided there is sufficient battery power). During door closure, an obstruction will cause the DC solenoid to engage the brake. A close command is needed to restart door closure after the obstruction is removed. If the AC power outage persists, before the battery system discharges totally, the fire door operator will play the audio/visual warning as described above, however, stop is not functional in this case. If the battery is at full charge, the door will close with approximately 10 close cycles possible.

Battery Mode and Alarm Condition

If AC power is lost and the system is operating on the battery back up system, upon receiving an alarm input, the audio/visual warning system is activated for the user-preset delay time. After the expiration of the time-to-close delay period (10, 20, 30 or 60 seconds), the door is released to fall via the DC solenoid brake control. If the door speed exceeds 9 in/sec, the brake is engaged until the door speed falls to 6 in/sec. If an obstruction is sensed during door closure, the brake engages and holds the door the preset time-to-close delay period. After holding the door for the delay period, the brake is released, stopping the door at the obstruction. Once the door activates the down limit, the audio/visual warning system is disabled.

Low Battery Condition

The fire door operator unit performs a battery test automatically every thirty days. The first load test occurs thirty days after initial powerup. The test involves placing the battery under a set load for a predetermined duration, preferably one hour plus or minus five minutes, to establish that it can hold the appropriate charge and operate the door in the event of an AC power failure and alarm condition. During this time, the battery serves as the sole power source for the brake solenoid for normal operation. If the battery discharges more than a predetermined amount, say 22.2 volts plus or minus 0.5 volts, during the test cycle, a low battery audio or visual warning is activated. The audio warning is from a buzzer, which emits a tone at 2 kilohertz, which sounds for three seconds, once a minute, until the battery is replaced. The unit will consider the battery has been changed if both AC and DC power is removed or both the Open and Close limit switches are pressed. If the door is in the close limit, the brake solenoid will be engaged during the load-test mode.

Software Listing

Attached hereto as Exhibit A is a source code listing for software used to control a programmable logic controller as described above.

Operational Specifications

Attached hereto as Exhibit B is a table of operational specifications for a programmable logic controller as described above.

While there has been illustrated and described a particular embodiment of the present invention, it will be appreciated that numerous changes and modifications will occur to those skilled in the art, and it is intended in the appended claims to cover all those changes and modifications which followed in the true spirit and scope of the present invention.

What is claimed is:

1. An operator for operating a fire door, the fire door having a drive shaft, comprising:

a motor having an output shaft coupled to the drive shaft;

a brake for holding the fire door in an open or a closed condition;

an electronically controlled descent device comprising:

a DC solenoid for engaging and disengaging the brake;

a speed sensor for detecting a descent speed of the fire door; and an electronic controller, responsive to the speed sensor, selectively enabling the DC solenoid when the descent speed reaches a predetermined minimum speed and disabling the DC solenoid when the descent speed reaches a predetermined maximum speed;

a limit shaft coupled to the output shaft for setting open limit and closed limit positions; and a DC power source for providing power to the electronically controlled descent device.

2. The operator of claim 1 further comprising an electronic control package for automatically opening and closing the fire door.

3. The operator of claim 2 further comprising circuitry for selecting an alarm contact type of an external alarm system for sending an alarm close command to the operator.

4. The operator of claim 2 further comprising an audio warning system for providing an audio warning prior to descent of the fire door.

5. The operator of claim 2 further comprising a visual warning system for providing a visual warning prior to descent of the fire door.

6. The operator of claim 1 further comprising a battery backup system for powering the electronically controlled descent device in the event of a failure of the DC power source.

7. The operator of claim 1 further comprising time delay circuitry for delaying descent of the fire door a time delay period after receipt of an alarm signal.

8. The operator of claim 7 further comprising apparatus for adjusting the time delay period.

9. The operator of claim 6 further comprising battery test circuitry for automatically testing the battery backup system.

10. The operator of claim 1 wherein the speed sensor detects rotation of the limit shaft.

11. The operator of claim 1 further comprising circuitry for selecting a time to close variable for delaying the time of descent in response to a close command initiated by an external alarm system.

12. An operator for operating a fire door, the fire door having a drive shaft, comprising:

a motor having an output shaft coupled to the drive shaft;

a brake for holding the fire door in an open or a closed condition;

an electronically controlled descent device comprising:

a DC solenoid for engaging and disengaging the brake;

a speed sensor for detecting a descent speed of the fire door; and an electronic controller, responsive to the speed sensor, selectively enabling the DC solenoid when the descent speed reaches a predetermined minimum speed and disabling the DC solenoid when the descent speed reaches a predetermined maximum speed;

a DC power source for providing power to the electronically controlled descent device;

time delay circuitry for delaying descent of the fire door a time delay period after receipt of an alarm signal; and apparatus for adjusting the time delay period.

13. An operator for operating a fire door, the fire door having a drive shaft, comprising:

a motor having an output shaft coupled to the drive shaft;

a brake for holding the fire door in an open or a closed condition; an electronically controlled descent device comprising:

a DC solenoid for engaging and disengaging the brake;

a speed sensor for detecting a descent speed of the fire door; and an electronic controller, responsive to the speed sensor, selectively enabling the DC solenoid when the descent speed reaches a predetermined minimum speed and disabling the DC solenoid when the descent speed reaches a predetermined maximum speed;

a DC power source for providing power to the electronically controlled descent device; and circuitry for selecting an alarm contact type of an external alarm system for sending an alarm close command to the operator.

* * * * *